US010472856B1

(12) United States Patent
Widén

(10) Patent No.: US 10,472,856 B1
(45) Date of Patent: Nov. 12, 2019

(54) CYLINDER LOCK AND KEY COMBINATION PROVIDING EXTRA CODE COMBINATIONS

(71) Applicant: WINLOC AG, Zug, Schweiz (CH)

(72) Inventor: Bo Widén, Torshälla (SE)

(73) Assignee: WINLOC AG, Zug (CH)

( * ) Notice: Subject to any disclaimer, the term of this patent is extended or adjusted under 35 U.S.C. 154(b) by 0 days.

(21) Appl. No.: 16/164,212

(22) Filed: Oct. 18, 2018

(51) Int. Cl.
*E05B 27/00* (2006.01)
*E05B 19/00* (2006.01)

(52) U.S. Cl.
CPC ..... *E05B 27/0078* (2013.01); *E05B 19/0023* (2013.01); *E05B 19/0064* (2013.01); *E05B 27/0017* (2013.01); *E05B 27/0039* (2013.01); *E05B 27/0057* (2013.01); *E05B 27/0082* (2013.01)

(58) Field of Classification Search
CPC ..... E05B 27/0078; E05B 27/0039; E05B 27/0057; E05B 19/0064; E05B 19/0023; E05B 27/0082; E05B 27/0017; E05B 19/0058; E05B 19/0035; E05B 2027/0025; E05B 2027/10
USPC ..... 70/405–407, 409, 492–496
See application file for complete search history.

(56) References Cited

U.S. PATENT DOCUMENTS 4,756,177 A * 7/1988 Widen ..... E05B 27/0039 70/358
4,815,307 A * 3/1989 Widen ..... B21D 53/42 70/378
5,715,717 A * 2/1998 Widen ..... E05B 19/0017 70/493
7,159,424 B2 * 1/2007 Widen ..... E05B 27/0039 70/409
7,487,653 B2 * 2/2009 Widen ..... E05B 27/0039 70/409
7,665,336 B2 * 2/2010 Widen ..... E05B 19/0023 70/409
7,665,337 B1 * 2/2010 Widen ..... E05B 19/0029 70/409
7,810,364 B2 * 10/2010 Widen ..... E05B 27/0039 70/409
8,061,168 B2 * 11/2011 Widen ..... E05B 19/0023 70/409
9,464,459 B2 * 10/2016 Walls ..... E05B 19/0017

* cited by examiner

*Primary Examiner* — Lloyd A Gall
(74) *Attorney, Agent, or Firm* — Birch, Stewart, Kolasch & Birch, LLP

(57) ABSTRACT

A lock and key combination providing extra code combinations. The lock has a housing and a cylindrical key plug with a keyway and at least side locking tumbler. The side locking tumbler has, at its rear side, a tongue which will fit into an associated recess in a side bar. The outer surface of the tongue is shaped as a groove between two vertical edge portions. One of these edge portions will make contact with the sidebar, adjacent to an entrance opening of the recess in the sidebar and thereby stop the tongue from entering into the rectangular recess if the side locking tumbler is rotationally misaligned. Because of this, it is possible to design the cylinder lock with a large number of predetermined code positions for each side locking tumbler. An associated key with a key blade having a wave-like side code pattern, will have, for each side locking tumbler, a selected one of a large number of predetermined different code positions.

24 Claims, 7 Drawing Sheets

1
A
103
101
102
2
A
1
107
110
103
101
106
105a
105b
104b
102
170
162
150
160

202
201
203
2
109
108
161
142
116
117
115
114
113
112
111

SECTION A-A
A
107
104a
101
142
102
104b
170
108
150
109
113
110
121
201
133
140
141

Fig 5a
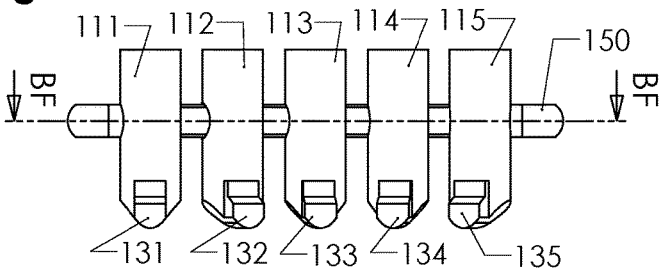
Fig 5b
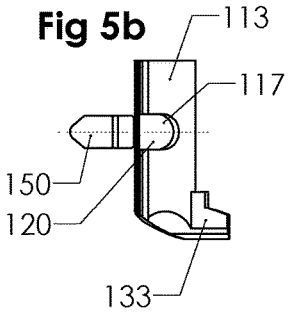
Fig 5c
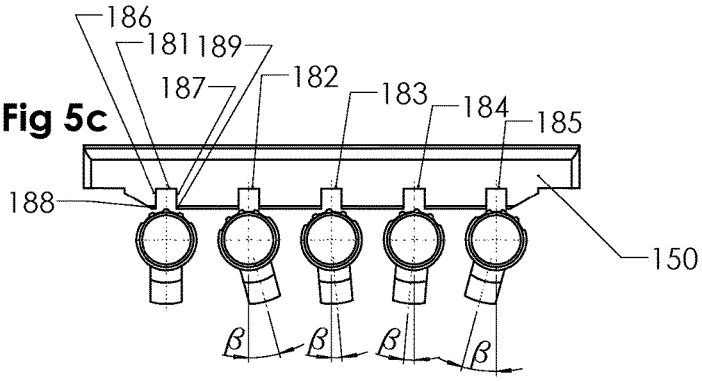
Fig 6a
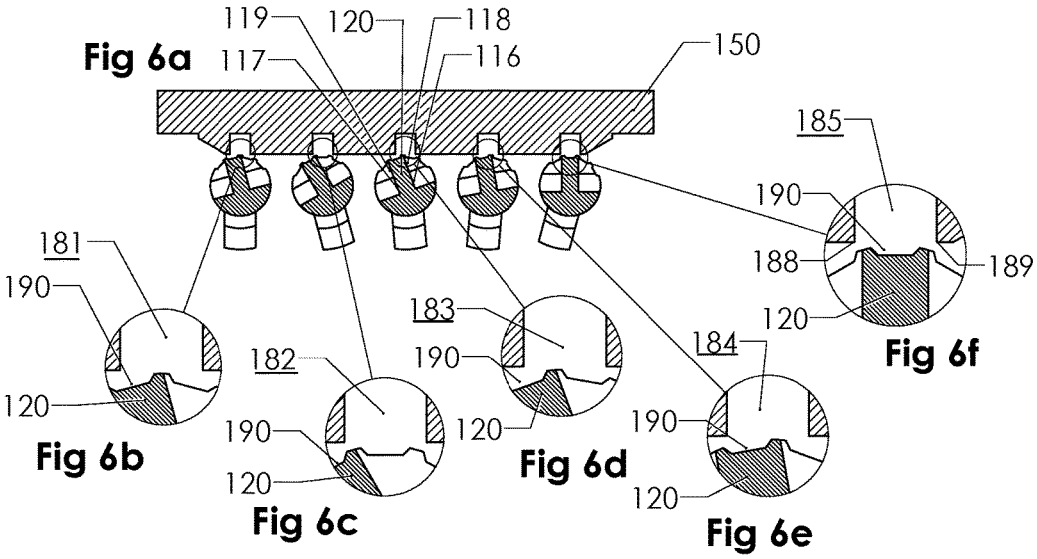
Fig 6b
Fig 6c
Fig 6d
Fig 6e
Fig 6f

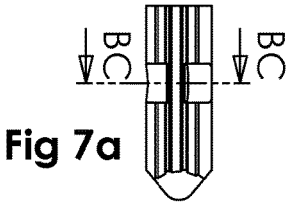
Fig 7a
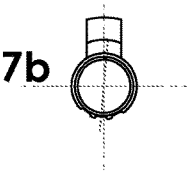
Fig 7b
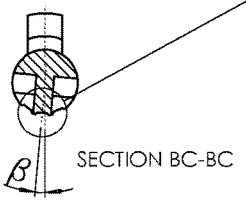
Fig 7c
Fig 7d
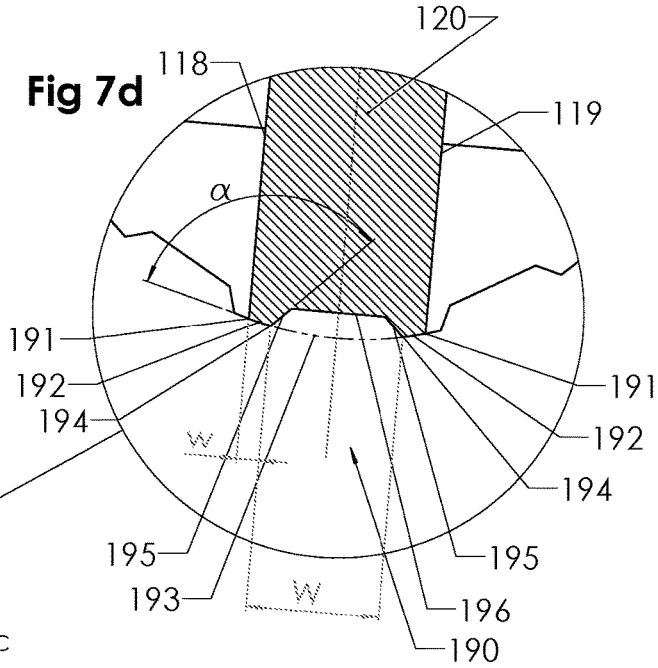
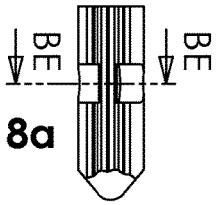
Fig 8a
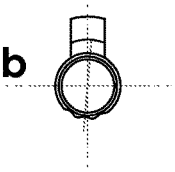
Fig 8b
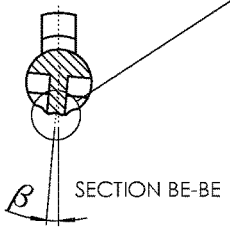
Fig 8c
Fig 8d
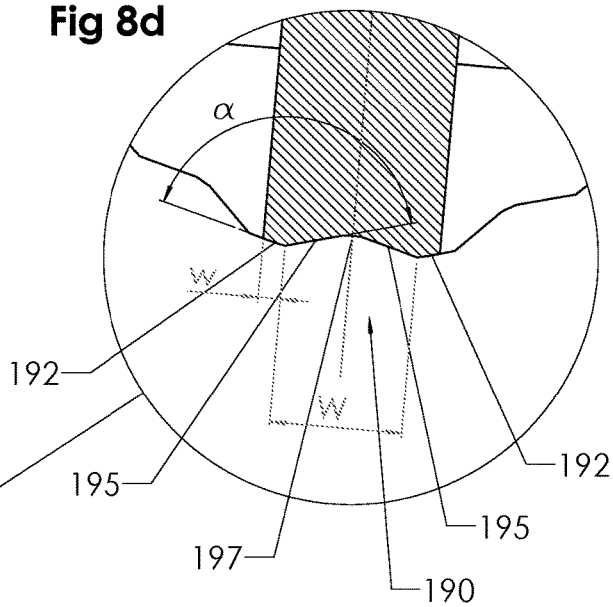

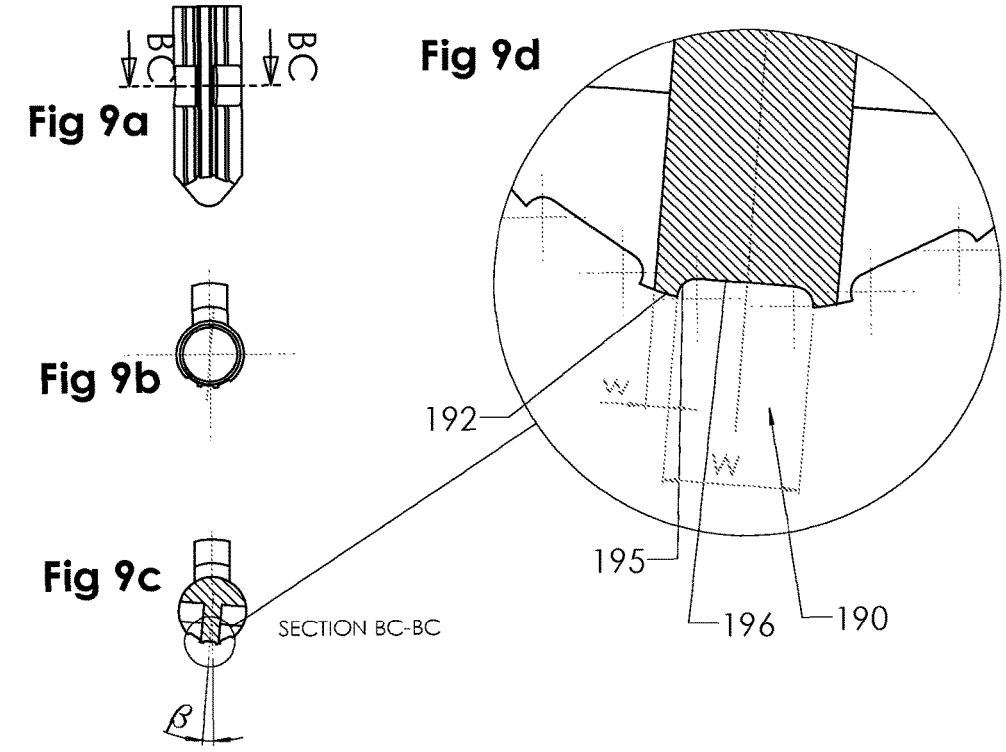
BC
BC
Fig 9a
Fig 9d
Fig 9b
192
W
W
195
Fig 9c
SECTION BC-BC
196
190
β
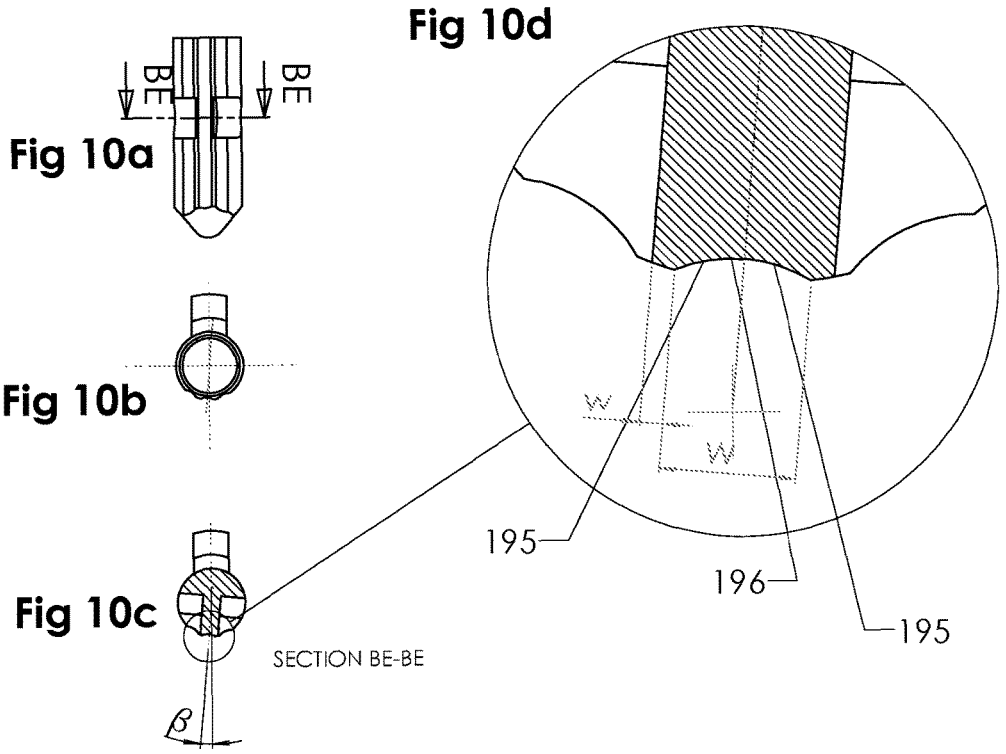
Fig 10d
BE
BE
Fig 10a
Fig 10b
W
W
195
196
195
Fig 10c
SECTION BE-BE
β

BC
BC

SECTION BC-BC
β

α
W
W
192
194
195
196
190
195
194
192

CYLINDER LOCK AND KEY COMBINATION PROVIDING EXTRA CODE COMBINATIONS

FIELD OF THE INVENTION

The present invention relates to a cylinder lock including a housing with a cylindrical bore and a cylindrical key plug provided with a number of locking tumblers, including at least one side locking tumbler and a side bar cooperating with each side locking tumbler, and providing a large number of code combinations. In turn, this will increase the security of the lock.

The invention also includes a lock and key combination, including a cylinder lock of the kind indicated above, a key with a key blade having a special kind of wave-like side code pattern and a set of keys having different specific code combinations.

In particular, the invention relates to a cylinder lock of the kind including:

a housing with a cylindrical bore, and a cylindrical key plug, which is rotatably mounted in said cylindrical bore and is provided with a longitudinal keyway and a number of locking tumblers, including at least one side locking tumbler having a transversely projecting finger and being mounted in an associated chamber for elevational and rotational movement therein, the rotational movement being confined between two angular end positions, said at least one side locking tumbler having a pair of side openings in a cylindrical surface at a back part, opposite to said finger, these side openings forming therebetween a tongue being dimensioned to cooperate with a sidebar, which is movable transversely towards a longitudinal central axis of said cylindrical bore, there being at least one spring urging the sidebar to move outwardly towards a groove in said housing, said sidebar having one or more recesses configured to receive said tongue of the at least one side locking tumbler upon rotating and lifting said locking tumbler into a predetermined position, the sidebar serving as a locking means for the lock but enabling the key plug to be rotated in said housing so as to release the lock when each side locking tumbler has been correctly positioned into said predetermined position, the tongue of the side locking tumbler being flat with opposite, mutually parallel inner surfaces and an elongated, peripheral outer surface; extending vertically in parallel to an axis of the side locking tumbler and facing the sidebar, and each recess in the sidebar being substantially rectangular in longitudinal section, with opposite inner wall surfaces having a mutual distance corresponding to the distance between the opposite surfaces of the associated tongue of the side locking tumbler, with a tolerance that enables the tongue, if correctly aligned elevationally and rotationally with the associated rectangular recess of the sidebar, to be inserted therein when the lock is to be released, each recess in the sidebar having right angle corner edges defining an entrance opening of the recess in a longitudinal flat surface of the side bar facing said rotatable key plug.

PRIOR ART

Such a cylinder lock (and key combination) is disclosed in the European Patent Specification EP 1,668,212 B1 (Winloc AG), where the code combinations include the angular end positions of each side locking tumbler for two elevational levels, two central angular positions of the side locking tumbler at two intermediate levels as well as an extra uppermost code level for the side locking tumbler resting with its pivotable transverse finger on a shelf of a wave-like side code pattern on the associated key, making a total of 7 code positions for each side locking tumbler and a very large total number of code combinations when the lock includes a number of side locking tumblers, e.g. 5 side locking tumblers.

OBJECT OF THE INVENTION

A major object of the invention is to provide a cylinder lock, and a cylinder lock and key combination, as referred to above, where the total number of code combinations is even greater, for each side locking tumbler.

According to a further object of the invention, this should be achieved without drastically changing the structure of the cylinder lock, the side locking tumblers, or the sidebar of the lock.

Furthermore, the invention should provide for an even higher security of the cylinder lock, by making it more difficult to manipulate the lock with incorrectly cut keys or other objects.

SUMMARY OF THE INVENTION

These objects are achieved for a cylinder lock of the above-mentioned kind, wherein:

said elongated, peripheral outer surface of said tongue of said side locking tumbler is shaped as a groove and has two parallel vertical edge portions forming a respective transition to an associated one of said opposite inner surfaces of said tongue, each said vertical edge portion comprises a first surface portion located substantially in a cylindrical contour of said side locking tumbler, each said first surface portion adjoins, via a second vertical edge, a second surface portion extending inwards in relation to said cylindrical contour, each said second surface forms a part of said groove and adjoins a bottom portion of the groove extending at a distance radially inwards in relation to said cylindrical contour, and one of said two vertical edge portions of said tongue portion will abut, with its second vertical edge, against said longitudinal flat surface of the sidebar, adjacent to said entrance opening of the associated rectangular recess, and thereby stop the tongue from entering into the rectangular recess in case the side locking tumbler is rotationally misaligned in relation to said associated recess when an incorrectly shaped key or other object is inserted into the keyway of the lock and a rotating torque is applied to the rotatable cylindrical key plug.

With such a groove at the outer surface of the tongue of the side locking tumbler, any misalignment will cause one of the vertical edge portions of the tumbler to abut against the side bar, at some distance from the entrance opening in the associated rectangular recess of the sidebar, in case a rotating torque is applied to the key plug, e.g. with an incorrectly cut key, and the side bar is moved radially inwards towards the key plug. Only when each side locking tumbler is perfectly aligned, rotationally as well as vertically, in relation to the associated rectangular recess in the sidebar will it be possible to cause each tongue to enter into its recess, so that the sidebar can move radially inwards and be released from its engagement with the groove in the housing. Then, the key plug can be rotated to open the cylinder lock, provided of course that all the other (central) locking tumblers are also moved by the key into their releasing positions.

The groove in the side locking tumbler may be formed in different ways.

Tests have shown that the tongue of the side locking tumbler will be prevented from entering into the associated recess in the sidebar in case it is angularly misaligned only a few degrees. It will not slide into the recess unless it is exactly aligned, so that the opposite, mutually parallel inner surfaces of the side openings are aligned in parallel to the associated parallel inner wall surfaces of the associated sidebar recess. In this way, it is possible to design the cylinder lock with a larger number of predetermined code positions for each side locking tumbler. The various angular positions can be placed closer to each other, even at the same vertical level, so the total number of code combinations can be increased substantially.

The flat tongue of a side locking tumbler may stand at a coded angle β in relation to a vertical plane containing an axis of the transversely projecting finger, the coded angle being selected from a set of angles ranging from +X° to −X° (X being e.g. 15°), with increments between Y° to Z° (Y being smaller than or equal to Z, e.g. 10°). Thus, the number of coded angles for each vertical level may be four or even five.

Furthermore, thanks to the high definition and preciseness of the side locking tumblers in relation to the side bar recesses, it is also possible to have smaller increments between the coded angles, if these code positions relate to higher or lower elevational positions of the side locking tumbler. Thus, the angular increments may be as small as 4° to 6° for such different elevational positions. With these small increments at higher or lower levels, the total number of code positions for each side locking tumbler may be as high as 11 or even higher. With five side locking tumblers in a cylinder lock, a typical embodiment, the total number of possible code combinations will be very large, e.g. in the order of 11×11×11×11×11=162 382 combinations, at least theoretically.

The invention also concerns a lock of the kind discussed above, in combination with an associated key fitting into the keyway of the lock, wherein the key has a wave-like side code pattern with a number of possible code locations corresponding to the coded positions of the side locking tumblers of the lock. The associated key will open the lock upon being inserted into the keyway and turning the key so as to turn the key plug in the cylindrical bore in order to push the sidebar towards the central axis and causing the tongues of the side locking tumblers to enter into the associated recesses of the sidebar.

BRIEF DESCRIPTION OF THE DRAWINGS

The invention will now be explained in detail with reference to some embodiments being illustrated on the appended drawings.

FIG. 5*a* shows five side locking tumblers inside the lock, without the key plug for clarity, and the associated sidebar located behind these side locking tumblers;

FIG. 5*b* shows a side view of one of the side locking tumblers of the lock, and a cross-section of the associated sidebar;

FIG. 5*c* shows a top view of the five side locking tumblers and the side bar of FIGS. 5*a* and 5*b;*

FIG. 6*a* shows a longitudinal section along the side bar and the associated side locking tumblers;

FIGS. 6*b*, 6*c*, 6*d*, 6*e* and 6*f* show enlarged views of the sidebar recesses and a part of each side locking tumbler in various angular positions;

FIG. 7*a* shows the back side of one of the side locking tumblers, in a first embodiment;

FIG. 7*b* shows a top view of the side locking tumbler of FIG. 7*a;*

FIG. 7*c* shows a cross-section through the side locking tumbler of FIG. 7*b*, along the line BC-BC;

FIG. 7*d* is an enlarged view of the end portion of a tongue which forms a part of the side locking tumbler of FIG. 7*a;*

FIGS. 8*a*, 8*b*, 8*c*, 8*d*, show views corresponding to those of FIGS. 7*a* to 7*d* of a modified, second embodiment of the side locking tumbler of FIG. 7*a;*

FIGS. 9*a*, 9*b*, 9*c*, 9*d* show corresponding views of a modified, third embodiment of the side locking tumbler of FIG. 7*a;*

FIGS. 10*a*, 10*b*, 10*c*, 10*d* show corresponding views of a modified, fourth embodiment of the side locking tumbler of FIG. 7*a*.

DETAILED DESCRIPTION OF PREFERRED EMBODIMENTS

Figures 1, 2, 3:
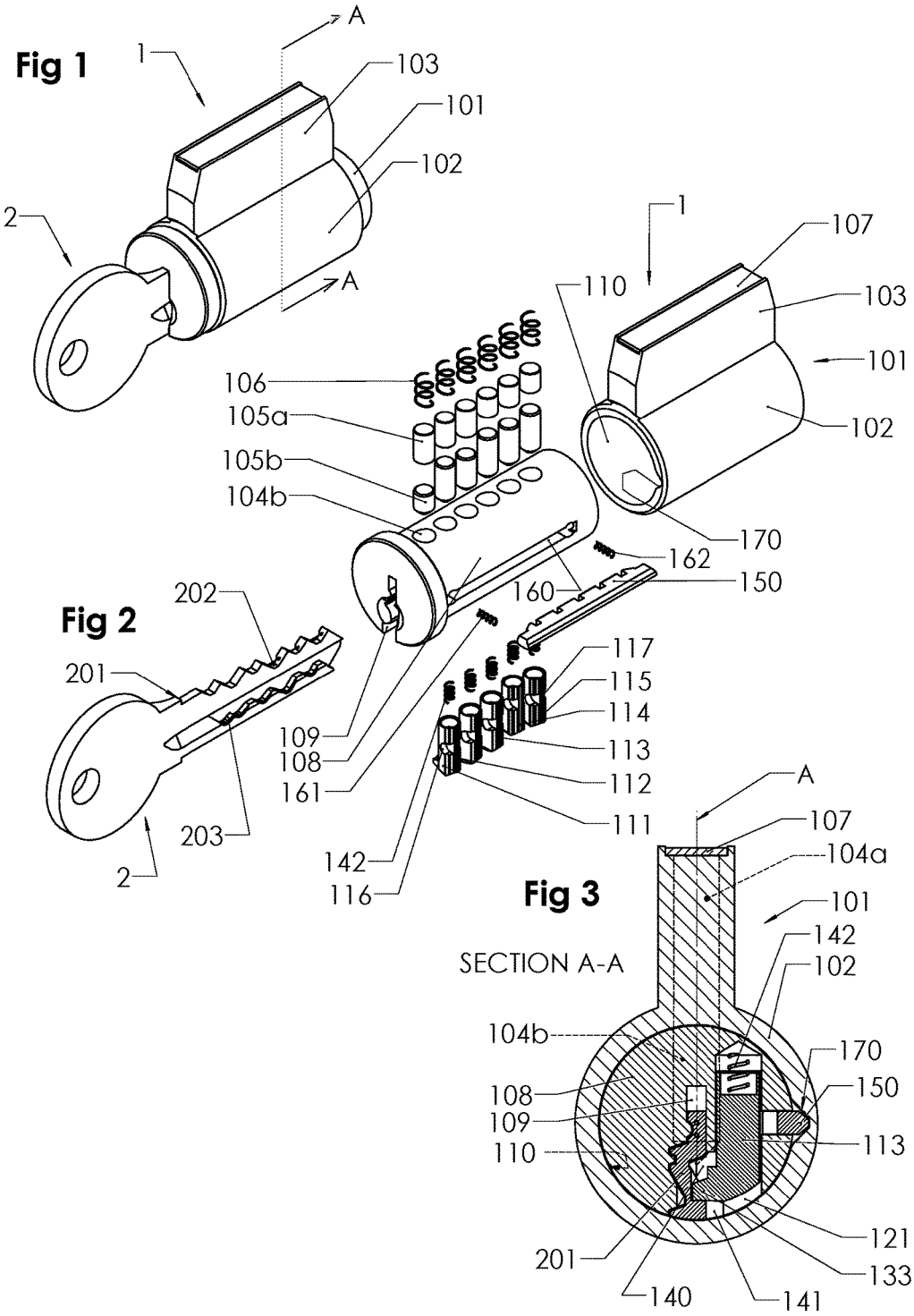
FIG. 1 shows in a schematic perspective view a cylinder lock according to the invention, with a key inserted into the lock.
FIG. 2 is an exploded, perspective view of the lock and key of FIG. 1, illustrating the various parts of a key plug and a housing with a cylindrical bore.
FIG. 3 shows a cross-section along the line A-A in FIG. 1, showing a cross-section through the key and a section through a side locking tumbler and a sidebar.
Figure 3A:
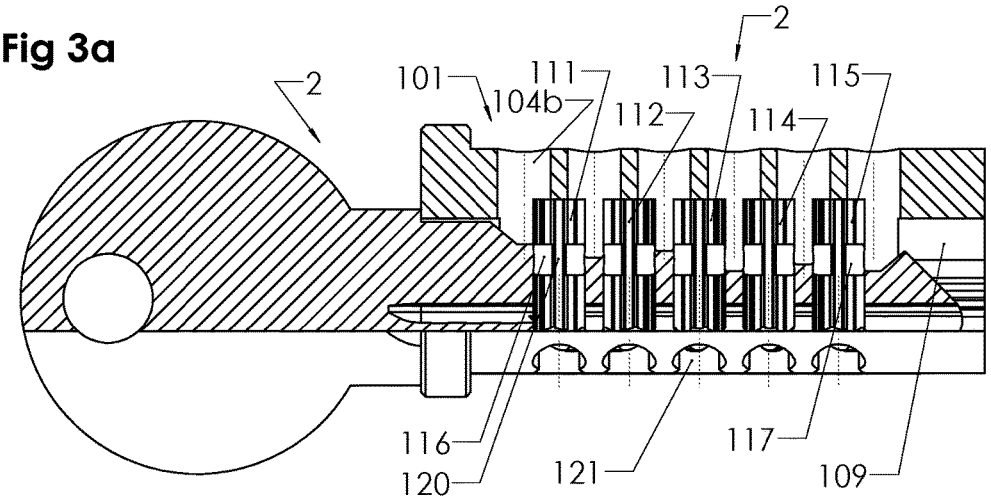
FIG. 3*a* shows, partly in a longitudinal, vertical section, the lock and the key plug of FIG. 2 in a side view.
Figure 3B:
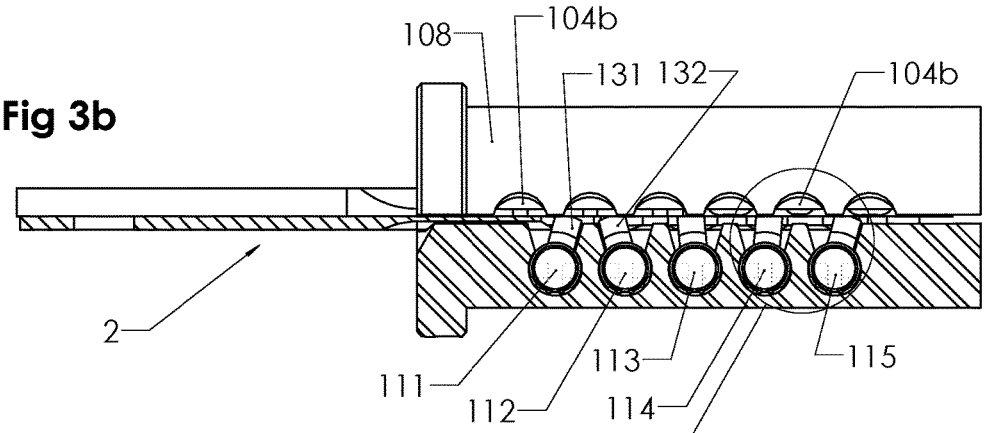
FIG. 3*b* shows, partly in a longitudinal, horizontal section, the lock and the key plug of FIG. 3*a* in a top view.
Figure 3C:
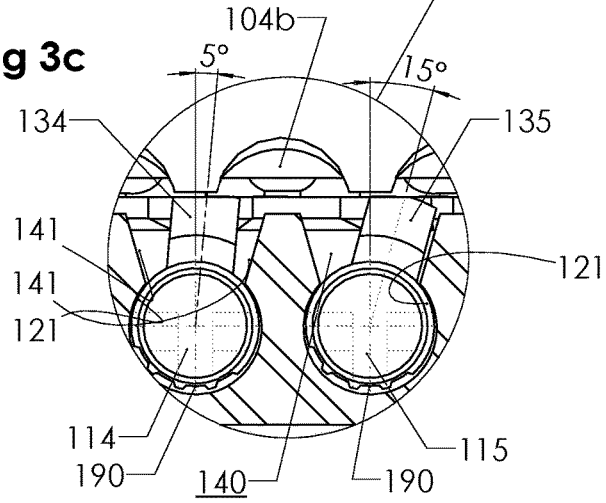
FIG. 3*c* shows an enlargement taken from FIG. 3*b;*

In FIGS. 1,2,3,3*a*,3*b*,3*c* there is shown schematically a cylinder lock and key system, including a cylinder lock according to the invention, and an associated key, of a kind similar to the one disclosed in the above-mentioned European Patent Specification EP 1,668,212 B1 (Winloc AG). The cylinder lock 1 comprises a housing 101 having a cylindrical housing part 102 and an upper housing part 103, with a row of central cavities 104*a* (FIG. 3) for accommodating a number of central locking pins 105*a*,105*b* (upper and lower pins) cooperating with an upper edge code pattern 202 on a key blade 201 of the key 2 (FIG. 2). The central locking pins 105*a*, 105*b* (six of them) are held down by springs 106 and a top cover plate 107 (FIGS. 2 and 3).

In a cylindrical bore 110 of the cylindrical part 102 of the housing 101, there is journalled a cylindrical key plug 108 provided with upper, central cavities 104*b* for receiving the upper and lower central locking pins 105*a*, 105*b*. When a correctly cut key 2 is fully inserted into a keyway 109 of the key plug 108, the top edge code pattern 202 will position the central locking pins 105*a*, 105*b*, so that their mutually abutting end surfaces are aligned with the shear line between the cylindrical housing 102 and the cylindrical key plug 108. Then, it is possible to turn the key plug 108 so as to open the lock (provided that there is no other mechanism preventing such a release).

In the cylindrical key plug 108, there is arranged, at a lateral side of the central keyway 109, a set of side locking tumblers 111,112,113, 114, 115 (five in the set in the illustrated embodiment—a typical example for this kind of high security locks), each side locking tumbler being movable vertically up and down (elevationally) as well as rotationally within an associated chamber 121 (five of them, one for each side locking tumbler, see FIG. 3). These chambers 121 are formed as cylindrical bores, each located at a lateral side of the keyway, with its vertical axis in parallel to a central plane A through the keyway 109. There are openings 140 between each such chamber 121 and the keyway, so as to accommodate a transverse finger 131, 132, 133, 134, 135 on each side locking tumbler 111,112,113, 114, 115. When the side locking tumbler rotates within its chamber 121, the transverse finger 131, 132, 133, 134, 135 will pivot back and forth while following a wave-like side code pattern 203 (FIG. 2) on the side of the key blade 201. The openings 140 between the chambers 121 and the keyway 109 have side wall surfaces 141, one on each side of the opening. These side wall surfaces 141 will limit the pivotal movement of the side locking tumbler finger 133, so that it is pivotable between two angular end positions, e.g. 15° backwards and forwards in the longitudinal direction of the key plug 108, in relation to a transverse direction (as shown in FIG. 5*a* for the finger 131) at right angle to the longitudinal direction of the keyway 109. See also FIG. 3*c*.

Each side locking tumbler 111, 112, 113, 114, 115 is biased downwardly by a spring 142, so that the finger will be urged downwardly to contact the wave-like side code pattern 203 of the key blade 201 when the key 2 is being inserted into the keyway.

The basic function of the side locking tumblers 111, 112, 113, 114, 115 is to block rotation of the key plug and keep the cylinder lock closed, unless all the side locking tumblers are precisely positioned elevationally and rotationally in relation to a side bar 150 which is seated in a longitudinal recess 160 (FIG. 2) in the outer circumferential surface of key plug. The sidebar is biased radially outwardly by means of helical springs 161, 162 arranged adjacent to the longitudinal ends of the sidebar. The springs will urge the sidebar outwardly into a longitudinal groove 170 formed in the wall surface of the cylindrical bore 110 (FIG. 2). The groove 170 is shaped in such a way, with slanted upper and lower side walls, that the side bar will be moved radially inwards when the key plug is turned within the cylindrical bore 110. This can be achieved with the key 2 that operates the lock 1.

As is known per se, e.g. from the above-mentioned European Patent Specification EP 1,668,212 B1 (Winloc AG), the cooperation between the side locking tumblers and the sidebar is accomplished by way of side openings in the cylindrical surface of the side locking tumbler 111, etc., at a back part therof, these side openings 116, 117 having inner surfaces 118,119 (see FIG. 6*a*) which form a tongue 120 therebetween. The tongue 120, which has a limited extension in the vertical direction (in parallel with an axis of the side locking tumbler) is dimensioned to fit, with some play, into a corresponding rectangular recess 181, 182, 183, 184, 185 in the side bar 150 (see FIG. 5*c*), there being one such recess for each side locking tumbler.

The recesses 181, 182, 183, 184, 185 are substantially rectangular in longitudinal section, as shown in FIG. 5*c*, with opposite inner wall surfaces 186, 187 having a mutual distance slightly exceeding the thickness (about 0.6 mm) of the associated tongue 120 at the back of the adjacent side locking tumbler, the play between these surfaces 186, 119 and 187, 118 being about 0.1 mm, the width of the recess thus being about 0.8 mm. The vertical corner edges 188, 189 (FIG. 6*f*), which define an entrance opening into the respective recess 181, etc., should be sharp so as to only permit the entrance of a tongue 120 being exactly aligned in parallel to the recess. Such an aligned tongue and recess is shown to the very right in FIG. 6*a*.

According to the present invention, the elongated, peripheral outer surface of the tongue 120 is configured in a special way in order to increase the preciseness of the mutual fitting of the tongue 120 of each side locking tumbler and the associated recess 181,182,183,184,185 in the side bar. This is accomplished by forming a groove 190 in the peripheral outer surface of the tongue 120, as shown in FIGS. 6*b*, 6*c*, 6*d*, 6*e*, 6*f*. The geometrical configuration of this groove is shown even more clearly in FIGS. 7*a*, 7*b*, 7*c* and especially in a larger scale in FIG. 7*d*.

More particularly, it will be seen from FIG. 7*d* that the inner surfaces 118, 119, at their outermost ends form a corner edge 191 which forms a transition to the peripheral outer surface of the tongue 120. This peripheral outer surface has a first surface portion 192 located substantially at the cylindrical contour 193 of the side locking tumbler 111, etc. This first surface portion ends at a second vertical edge 194 and has a rather small width w being about 0.1 mm and being about 10-20% of the total width W of the tongue.

The groove 190 in the outer surface starts at each second vertical edge 194, there being a second surface portion 195 extending inwards in relation to the cylindrical contour 193. The angle α between the first and second portions 192, 195 is about 90° to 150°, typically about 135°. In this way, the adjoining surfaces 118, 192 and 195 will form an edge portion which will be sturdy and strong and will resist wear during long use of the lock. The first and second vertical edges 191, 194 will be somewhat bevelled after long use, but each edge portion 118, 192, 195 will nevertheless be intact even after long use.

The second surface portions 195 are joined by a substantially straight bottom portion of the groove, this bottom portion 196 forming a third surface portion and extending at some distance (about 0.1 to 0.2 mm) from the outer cylindrical contour 193.

The width W of the groove, measured between the second vertical edges 194, is about 0.6 mm in this particular embodiment.

Of course, the exact geometrical configuration can be modified within the scope of the claims. As shown in FIGS. 8*a*, 8*b*, 8*c*, 8*d*, the second surface portions 195, being substantially flat in this embodiment as well, may extend longer towards the middle of the groove 190 and meet each other along a central vertical line 197 at a deepest point of the groove 190. In this embodiment the angle α between the first and second surfaces 192, 195 is greater, about 150°.

In a further modified third embodiment, as shown in FIGS. 9*a*, 9*b*, 9*c*, 9*d*, the angle between the first surface portion 192 and the second surface portion 195 is much smaller, about 90', but the second surface portion is arcuately curved (with a rather small radius of about 0.1 mm). In this case the third surface portion 196, forming the bottom of the groove 190, is substantially flat as in the embodiment of FIG. 7*d*.

A further, fourth embodiment, as shown in FIGS. 10*a*, 10*b*, 10*c*, 10*d*, has second and third surface portions merging with each other so as to form a continuous, concavely curved bottom portion 195, 196 of the groove, the radius of the curvature being about 0.5 mm and the angle α being about 150°.

In a fifth embodiment, shown in FIGS. 11*a*, 11*b*, 11*c*, 11*d*, the groove 190 comprises two flat side walls (second surface portions 195) and a slightly concavely curved bottom portion (third surface portion 196).

Irrespective of the particular geometrical configuration of the groove 190 in the peripheral outer surface of the tongue 120 of the side locking tumbler 111, etc., the edge portion 118, 192, 195 of the tongue, on each side of the groove, especially the second vertical edge 194, will contact the sidebar at a point outside the recess 181,182, 183, 184, in case the side locking tumbler 111, 112, 113, 114 is not exactly angularly aligned in parallel to the recess, as can be understood from the FIGS. 6*a*, 6*b*, 6*c*, 6*d*, 6*e*. Only if the tongue 120 is exactly aligned, as shown in FIG. 6*f* and to the very right in FIG. 6*a*, will the tongue 120 find its way into the associated recess, without touching the corner portions 188,189 of the recess 185.

Figure 4:
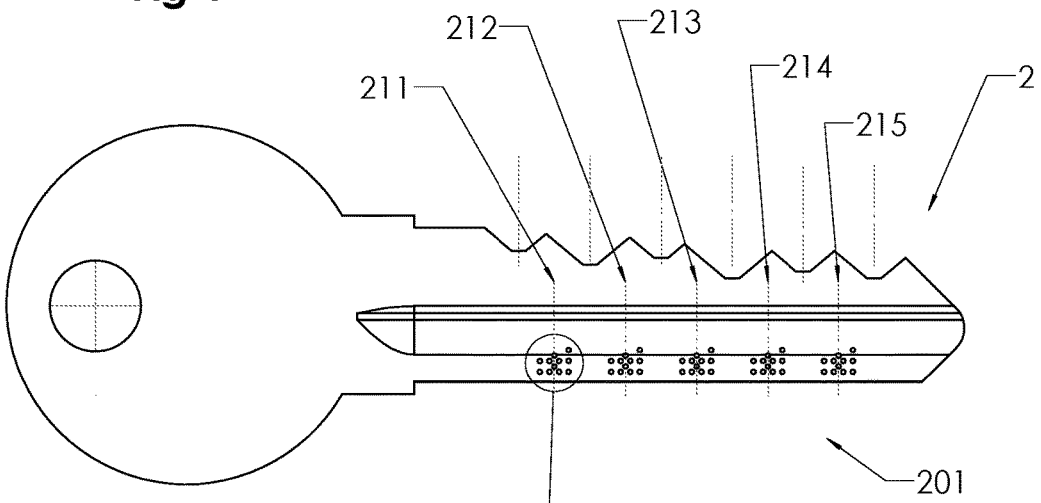
FIG. 4 shows a schematic side view of the key of FIGS. 1 and 2, illustrating the possible code positions in a side code pattern for cooperation with five side locking tumblers in the associated lock.
Figure 4A:
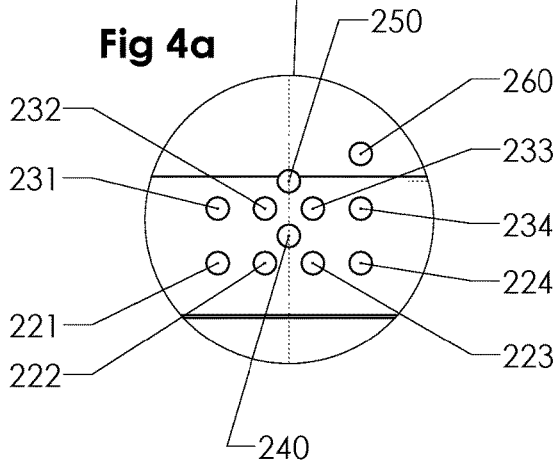
FIG. 4*a* is an enlarged portion of the code positions at one of the tumbler positions.
Figures 11A, 11B, 11C, 11D:
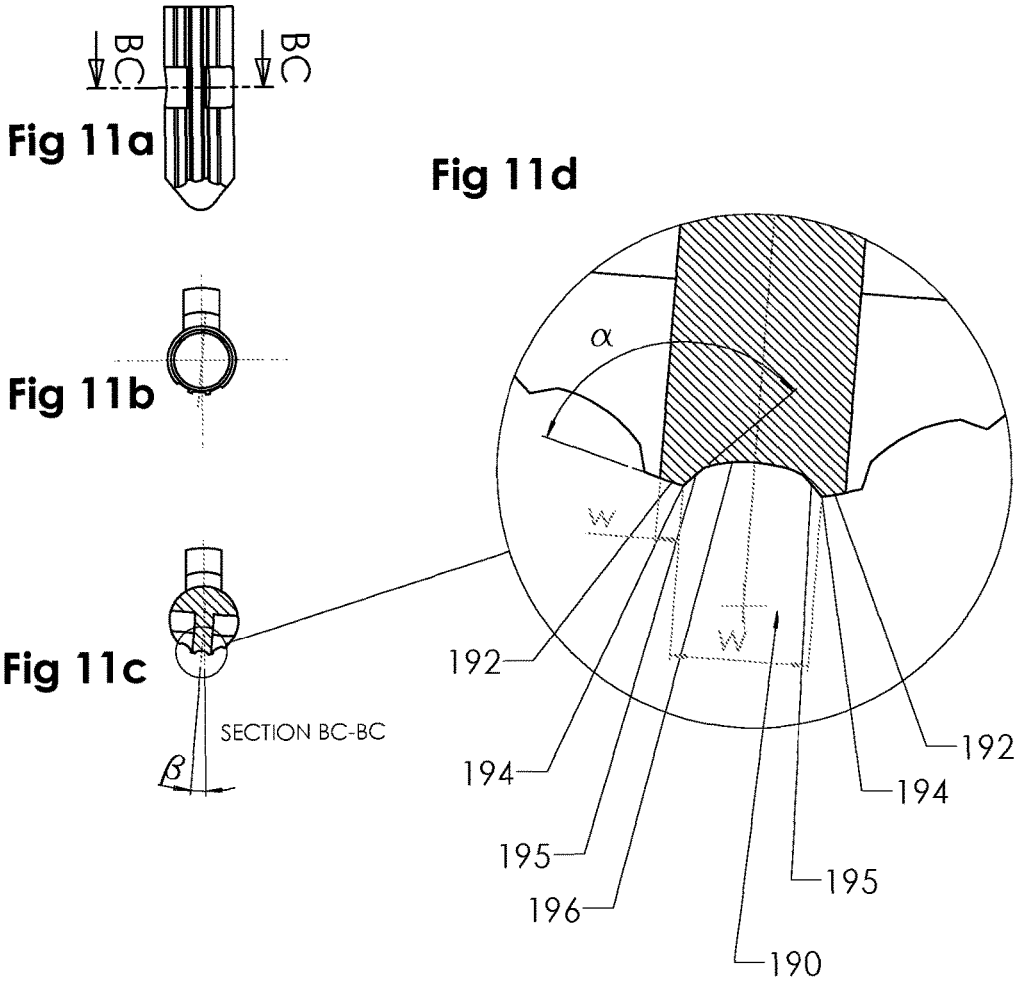
FIGS. 11*a*, 11*b*, 11*c*, 11*d* show corresponding views of a modified, fifth embodiment of the side locking tumbler of FIG. 7*a.*

As a result of the precise fitting of the tumbler tongues 120 in the recesses 181, etc. of the sidebar 150, the wave-like side code pattern 203 (FIG. 2) on the key blade 201 may include, for each side locking tumbler position 211, 212, 213, 214, 215 (FIG. 4), a very large number of possible code positions for the finger 133, located rather close to each other. As indicated in the enlarged portion shown in FIG. 4*a*, there are four code positions 221,222, 223, 224 and 231, 232, 233, 234, corresponding to various angular positions, for each one of two different elevational levels for the transverse finger 133 of the side locking tumbler resting on these code portions of the side code pattern 203 of the key blade 201. The code positions 221 and 231 correspond to a first angular end position of the finger 133, e.g. −15°, and the code positions 224 and 234 correspond to a second angular end position of the finger 133, e.g. at +15°. The code positions 222 and 232 correspond to angular positions at −5°, and the code positions 223 and 233 correspond to angular positions at +5°, thus with increments of 10° between the various angular positions of the finger 133. See also FIG. 3*c*.

There are two further code positions 240 and 250, at other elevational levels, corresponding to angular positions at 0°, i.e. at right angle to the plane of the key blade 201. Finally, there is a further code position 260 at a highest level, formed by uppermost shelf surfaces of the side code pattern 203. Such an extra code level is explained in detailed in the above-mentioned European Patent Specification EP 1,668, 212 B1.

It will be appreciated that these code positions, namely 11 of them, for each side locking tumbler, constitute a very high number, as compared to the prior art, represented by the above-mentioned European Patent Specification EP 1,668, 212 B1, where the corresponding number of code positions for a side locking tumbler was seven. This great increase has been made possible by the precise fitting between the tongue of the side locking tumbler and the associated recess in the side bar, making it possible to assign different codes to angles being only slightly different from each other, e.g. with angular increments in the order of 5 to 10 degrees, for the same elevational level of a side locking tumbler.

In the drawings showing the side locking tumblers of the present invention, there are several grooves located adjacent to each other. Of course, all these grooves are not being utilized for a particular side locking tumbler. However, it will facilitate the series production of coded side locking tumblers if several grooves, e.g. three, four or five grooves, are already made on all blanks beforehand, rather than machining each coded tumbler specifically in accordance with a given code. On the prefabricated tumbler blanks, the surface portions located between the grooves are about double the circumferential extension of the "first surface portions" referred to above.

The grooves at the outer surfaces of the tongues of the side locking tumblers may be configured slightly different from the examples shown. Thus, there may be a number of surface segments, being flat or arcuate, in a sequence from one vertical edge portion to the other one, as long as all these segments are located at a distance inwardly from the cylindrical contour of the tumbler.

Moreover, the particular angles at the end positions of the pivotable fingers, and the various angles therebetween, may be varied. For instance, the end positions may be up to 20° or even more, and the angular increments may be as low as 4°.

Of course, the number of side locking tumblers may also vary. There may be only one side locking tumbler, or more or less than 5 side locking tumblers, in addition to the regular central locking pins.

The invention claimed is:

1. A cylinder lock including a housing with a cylindrical bore, and a cylindrical key plug, which is rotatably mounted in said cylindrical bore and is provided with a longitudinal keyway and a number of locking tumblers, including at least one side locking tumbler having a transversely projecting finger and being mounted in an associated chamber for elevational and rotational movement therein, the rotational movement being confined between two angular end positions, said at least one side locking tumbler having a pair of side openings in a cylindrical surface at a back part, opposite to said finger, these side openings forming therebetween a tongue being dimensioned to cooperate with a sidebar, which is movable transversely towards a longitudinal central axis of said cylindrical bore, there being at least one spring urging the sidebar to move outwardly towards a groove in said housing, said sidebar having one or more recesses configured to receive said tongue of the at least one side locking tumbler upon rotating and lifting said locking tumbler into a predetermined position, the sidebar serving as a locking means for the lock but enabling the key plug to be rotated in said housing so as to release the lock when each side locking tumbler has been correctly positioned into said predetermined position, the tongue of the side locking tumbler being flat with opposite, mutually parallel inner surfaces and an elongated, peripheral outer surface, extending vertically in parallel to an axis of the side locking tumbler and facing the sidebar, and each recess in the sidebar being substantially rectangular in longitudinal section, with opposite inner wall surfaces having a mutual distance corresponding to the distance between the opposite surfaces of the associated tongue of the side locking tumbler, with a tolerance that enables the tongue, if correctly aligned elevationally and rotationally with the associated rectangular recess of the sidebar, to be inserted therein when the lock is to be released, each recess in the sidebar having right angle corner edges defining an entrance opening of the recess in a longitudinal flat surface of the side bar facing said rotatable key plug, wherein:

said elongated, peripheral outer surface of said tongue of said side locking tumbler is shaped as a groove and has two parallel vertical edge portions forming a respective transition to an associated one of said opposite inner surfaces of said tongue, each said vertical edge portion comprises a first surface portion located substantially in a cylindrical contour of said side locking tumbler, each said first surface portion adjoins, via a second vertical edge, a second surface portion extending inwards in relation to said cylindrical contour, each said second surface portion forms a part of said groove and adjoins a bottom portion of the groove extending at a distance radially inwards in relation to said cylindrical contour, and one of said two vertical edge portions of said tongue will abut, with its second vertical edge, against said longitudinal flat surface of the sidebar, adjacent to said entrance opening of the associated rectangular recess, and thereby stop the tongue from entering into the rectangular recess in case the side locking tumbler is rotationally misaligned in relation to said associated recess when an incorrectly shaped key or other object is inserted into the keyway of the lock and a rotating torque is applied to the rotatable cylindrical key plug.

2. The cylinder lock as defined in claim 1, wherein said second surface portions are substantially flat and meet each other along a central line at a deepest part of the bottom portion of the groove.

3. The cylinder lock as defined in claim 1, wherein said second surface portions are substantially flat and adjoin a central third surface portion forming a central part of said bottom portion of the groove.

4. The cylinder lock as defined in claim 3, wherein said third surface portion is substantially flat.

5. The cylinder lock as defined in claim 3, wherein said third surface portion is concavely curved.

6. The cylinder lock as defined in claim 1, wherein said second surface portions are concavely curved and merge with a third surface portion forming a central part of said bottom portion which is substantially flat.

7. The cylinder lock as defined in claim 1, wherein said second surface portions are concavely curved and merge with a third surface portion being concavely curved.

8. The cylinder lock as defined in claim 1, wherein said first surface portion of each vertical edge portion has a width being 10% to 20% of the width of said groove, measured between said second vertical edges.

9. The cylinder lock as defined in claim 8, wherein said first surface portion of each vertical edge portion has a width of about 0.1 mm and the width of said groove is about 0.6 mm.

10. The cylinder lock as defined in claim 1, wherein each said second surface portion, at said second vertical edge, stands at an angle of 90° to 150° to the adjoining first surface portion.

11. The cylinder lock as defined in claim 10, wherein said angle between each said second and said adjoining first surface portions is about 135°.

12. The cylinder lock as defined in claim 1, wherein said flat tongue of said side locking tumbler is standing at a coded angle in relation to a vertical plane containing an axis of said transversely projecting finger, said coded angle being selected from a set of angles ranging from +X° to −X°, with increments between Y° and Z°, for a particular elevational position of the associated side locking tumbler, where X is 10° to 20°, Z is smaller than X, Y is smaller than or equal to Z, and X, Y and Z are selected such that said set includes at least three different angles for said particular elevational position.

13. The cylinder lock as defined in claim 12, wherein X, Y and Z are selected such that said set includes at least four or five different coded angles for said particular elevational position.

14. The cylinder lock as defined in claim 13, wherein

X=about 15°, and

Y=Z=about 10°.

15. The cylinder lock as defined in claim 12, wherein said flat tongue is standing at a further coded angle (γ) differing from any one of the coded angles (β) in said set of coded angles by an increment of 4° to 6° for a locking tumbler being coded for an elevational position being higher or lower than said particular elevational position.

16. The cylinder lock as defined in claim 12, wherein said flat tongue is standing at a coded angle of +X° for an elevational position at an extra high code level, where said transversely projecting finger of a side locking tumbler rests on an uppermost horizontal segment of a wave-like side code pattern on a key associated with said lock.

17. The cylinder lock as defined in claim 1, in combination with an associated key fitting into said keyway of the lock, wherein said key has a wave-like side code pattern with a number of possible code locations corresponding to coded positions of said at least one side locking tumbler of the lock, so that said associated key will open said lock upon being inserted into said keyway and turning the key so as to turn the rotatable key plug in said cylindrical bore in order to push the sidebar towards said central axis and causing the tongue of said at least one side locking tumbler to enter into the associated one or more recesses of the sidebar.

18. A key having a key blade with a wave-like side code pattern comprising:

at least four predetermined different code positions located adjacent to a central position corresponding to a central position of a respective transverse finger of at least one of a side locking tumbler of an associated cylinder lock having a key plug being rotatable in a housing, said at least four predetermined different code positions, at a same vertical level relative to a longitudinal axis of the key blade, include at least two forward positions being located in front of said central position along a longitudinal direction of said longitudinal axis of the key blade, and at least two rear positions being located behind said central position in said longitudinal direction, said at least four predetermined different code positions correspond to at least four different angular positions of said respective transverse finger on said at least one side locking tumbler of a respective lock associated with the key, two of said at least four different angular positions being angular end positions, and wherein a selected one of said at least four predetermined different code positions is utilized for said key for selecting one of the at least four different angular positions of said respective transverse finger on said at least one side locking tumbler of a respective lock associated with the key.

19. The key as defined in claim 18, wherein the increments between said at least four predetermined different code positions along said longitudinal axis, at said vertical level, are substantially the same.

20. The key as defined in claim 19, wherein there are at least four predetermined different code positions on each one of two different vertical levels on the key blade.

21. The key as defined in claim 20, wherein there is at least one further code position, located at said central position, at a vertical level between said two different vertical levels.

22. The key as defined in claim 21, wherein there is at least one still further code position, also located at said central position, at a vertical level above the highest one of said two different vertical levels.

23. The key as defined in claim 22, where there is one extra code position at an even higher, uppermost vertical level corresponding to a shelf surface from which the wave-like side code pattern is cut downwardly, all other code positions being formed by concavities in the wave-like side code pattern, said one extra code position being located at a horizontal segment of said shelf surface, at said uppermost vertical level.

24. A set of keys as defined in claim 18, the set of keys including keys having different predetermined code combinations.

* * * * *